US005705243A

United States Patent [19]

Mehta et al.

[11] Patent Number: 5,705,243

[45] Date of Patent: Jan. 6, 1998

[54] BUSINESS FORM OR MAILER INTERMEDIATE WITH PROTECTIVE LAMINATE

[75] Inventors: Rajendra Mehta, Centerville; William P. Thomas, Miamisburg, both of Ohio; John C. McComas, Citrus Heights, Calif.

[73] Assignee: The Standard Register Company, Dayton, Ohio

[21] Appl. No.: 425,867

[22] Filed: Apr. 20, 1995

[51] Int. Cl.[6] ..... B42D 15/04

[52] U.S. Cl. ..... 428/40.1; 229/92; 229/92.1; 229/92.3; 229/92.5; 428/41.7; 428/41.9; 428/42.1; 428/43; 428/67; 428/137; 428/138; 428/192; 428/194

[58] Field of Search ..... 428/40, 41, 42, 428/43, 67, 137, 138, 192, 194; 229/92, 92.1, 92.3, 92.5

[56] References Cited

U.S. PATENT DOCUMENTS

| | | | |
|---|---|---|---|
| 4,200,222 | 4/1980 | Feuer | 229/92.8 |
| 4,778,153 | 10/1988 | Bachman | 229/92.8 |
| 4,787,160 | 11/1988 | Balsamo | 229/92.8 |
| 4,982,894 | 1/1991 | Schmidt | 229/69 |
| 4,986,868 | 1/1991 | Schmidt | 156/249 |
| 4,993,752 | 2/1991 | Juszak | 428/40 |
| 5,096,229 | 3/1992 | Carlson | 283/75 |
| 5,131,686 | 7/1992 | Carlson | 283/75 |
| 5,172,938 | 12/1992 | Schmidt | 283/109 |
| 5,217,775 | 6/1993 | Wedekind | 428/40 |
| 5,219,183 | 6/1993 | McKillip | 428/40 |

*Primary Examiner*—Nasser Ahmad

*Attorney, Agent, or Firm*—Killworth, Gottman, Hagan & Schaeff, LLP

[57] ABSTRACT

A business form or mailer intermediate having a built-in laminated portion is provided. The form or mailer includes a base ply provided on or in one panel and a film ply provided in a second panel. When the form or mailer is folded about a fold line, the film ply adheres to the base ply with a laminating adhesive. The base ply to be laminated may be a card or label.

36 Claims, 4 Drawing Sheets

BUSINESS FORM OR MAILER INTERMEDIATE WITH PROTECTIVE LAMINATE

BACKGROUND OF THE INVENTION

This invention relates to a mailer intermediate or business form, and more particularly to a mailer intermediate or business form including a portion, such as a label or card, with a protective laminate formed by folding the form or mailer intermediate.

In recent years, a rising demand for cards and labels of various types, such as membership or insurance cards or identification labels, has led to an increased demand for mailer intermediates or business forms which include such cards or labels. Consequently, there has evolved a demand for protective coverings such as laminates on the cards or labels. Additionally, the recent rise in computer automated mailing systems involving automated printing, such as laser, impact, ink jet, and thermal transfer printers, has led to an effort to develop improved mailer intermediates or business forms which may be printed in such automated systems, preferably in one pass through the printing system. Accordingly, a protective covering would need to be incorporated into such automated systems.

Traditional means of applying laminate coverings involves passing the card or label to be laminated through a lamination machine. However, such systems are generally hand operated and incapable of high speed, automated processing. Further, such systems generally do not allow the card or label to be incorporated into a business form or mailer intermediate.

U.S. Pat. No. 4,930,234 to Schmidt discloses a foldable I.D. card. However, the card is not part of a business form or mailer intermediate. Additionally, the card does not include a protective laminate covering.

U.S. Pat. No. 4,982,894 to Schmidt discloses a mailer including an I.D. card. The card contains multiple layers or plies including a top layer, a film layer, an adhesive layer and a card layer. However, the card does not disclose a business form or mailer intermediate wherein the card ply and the film ply are disposed in different panels of the form or mailer and the film ply is applied to the card ply when the form or mailer is folded. Indeed, the mailer is not folded. Rather the mailer of Schmidt '894, is formed with the top layer as the outer surface. The laminate is applied by the recipient when the mailer is opened. Thus, the card may become damaged during delivery.

U.S. Pat. No. 5,172,938 to Schmidt discloses an I.D. card product. The card contains multiple layers or plies including a top layer, a film layer, an adhesive layer and a card layer. However, the card does not disclose a business form or mailer intermediate wherein the card ply and the film ply are disposed in different panels of the form or mailer and the film ply is applied to the card ply when the form or mailer is folded. Further, Schmidt '938 fails to disclose a mailer for the card.

Accordingly, there remains a need in the art for an improved mailer intermediate or business form which includes a portion, such as card or label, with a protective laminate formed by folding the mailer intermediate or business form.

SUMMARY OF THE INVENTION

This need is met by the present invention wherein an improved mailer intermediate or business form is provided.

The mailer intermediate or form of the present invention includes a integral portion, such as a card or label, with a protective laminate which is applied to the portion when the form or mailer is folded. The mailer or form of the present invention is uniquely suited for the automated high speed printing systems common today and eliminates the time consuming process of hand-fed laminating machines. The present invention is ideally suited for the mailing of identification cards, such as insurance or membership cards, or auto license labels.

In a first embodiment of the present invention, a business form or mailer intermediate is provided. The mailer or form comprises a substrate sheet having first and second surfaces, first and second parallel longitudinal edges and first and second opposite ends. At least a first transverse fold line is formed in the substrate perpendicular to the parallel longitudinal edges dividing the substrate into at least first and second panels.

A base ply portion is provided on or in the first surface in the first panel. The base ply portion itself has an upper and lower surface. The base ply portion is formed in said substrate on the first surface of the substrate. The base ply portion is preferably either a card formed in the substrate or label formed on the substrate. In addition, multiple base ply portions may be provided. When the base ply portion includes a label formed on the substrate, a label adhesive is disposed on or adhered to the lower surface of the base ply portion. Preferably, a release liner ply is provided in contact with the label adhesive on the first surface of the substrate sheet in the first panel. The label is then releasably adhered to the liner ply by means of the label adhesive. The label adhesive is preferably a pressure sensitive adhesive.

A film ply portion is provided on the first surface of the second panel. The film ply portion also has an upper and lower surface. The film ply portion is provided in such a manner so that when the mailer or form is folded about the first fold line, the film ply portion and the base ply portion come into contact. A latent, activatable laminating adhesive is provided on the upper surface of the base ply, the film ply, or both. Preferably the laminating adhesive is a heat seal or pressure seal adhesive. Thus, when the film ply and the base ply are in contact, they adhere to each other forming a laminated base ply portion. When multiple base ply portions are provided, multiple film ply portions are also provided. The film ply portion preferably is initially adhered to the first surface of the second panel by a releasable, film adhesive, preferably a dry-residue adhesive.

In a feature of the present invention, the film ply portion may include lines of weakness which in turn define a center portion and an edge portion. The film adhesive, here preferably a permanent adhesive, may be disposed on the lower surface of the edge portions of the film ply. In this feature, only the central portion of the film ply then adheres to the base ply when the form or mailer is folded.

In additional features, the portion of the second panel lying in register with the center portion of the film ply may be removed by die-cutting a hole to allow the base ply portion to be viewed through the film when the form or mailer is folded. The film ply may optionally be a two-ply film having a first film and a second film releasably adhered to each other. The second film is adhered to the second panel with a mounting adhesive pattern, preferably a permanent adhesive. In this feature, the first film adheres to the base ply upon folding, while the second remains adhered to the second panel.

In a further embodiment of the present invention, a third panel is added to the mailer or form of the present invention.

The third panel is formed by adding a second transverse fold line to the substrate sheet. The second fold line defines the third panel adjacent to either the first or second panels.

Longitudinal lines of weakness may be added adjacent to the first and second longitudinal edges to form marginal strips between the lines of weakness and the first and second longitudinal edges. An edge adhesive may be provided on the first surface of the marginal strips in at least one of the first and second panels to secure the two panels together when folded. A sealing adhesive may also be disposed in the marginal strips on at least one of either the first surface of the third panel and the second surface of the first panel (C-fold), or alternatively, on at least one of the second surface of the third panel and the second surface of the second panel (Z-fold) to secure the third panel when folded. An end adhesive may also be disposed adjacent the first or second opposite ends. An address window may also be formed in one of the first or second panels.

Accordingly, it is a feature of the present invention to provide a mailer intermediate or business form having a built-in portion such as a card or label, with a protective laminate formed on the portion when the form or mailer intermediate is folded. It is a further feature of the present invention to provide either a two or three panel substrate sheet containing an integral card or label having a protective laminate. These, and other features and advantages of the present invention will become apparent from the following detailed description, the accompanying drawings and the appended claims.

DETAILED DESCRIPTION OF THE PREFERRED EMBODIMENTS

The present invention provides an improved mailer intermediate or business form which will permit the application of individualized information to labels, cards, or tags. The form or mailer of the present invention may be printed by means of automated printing systems such as laser, ink jet, thermal transfer, impact or various other printing systems. The form or mailer of the present invention may be provided in single sheet or continuous web formats. Furthermore, the form or mailer of the present invention may be either simplex or duplex printed with both variable and nonvariable information.

Figure 1:
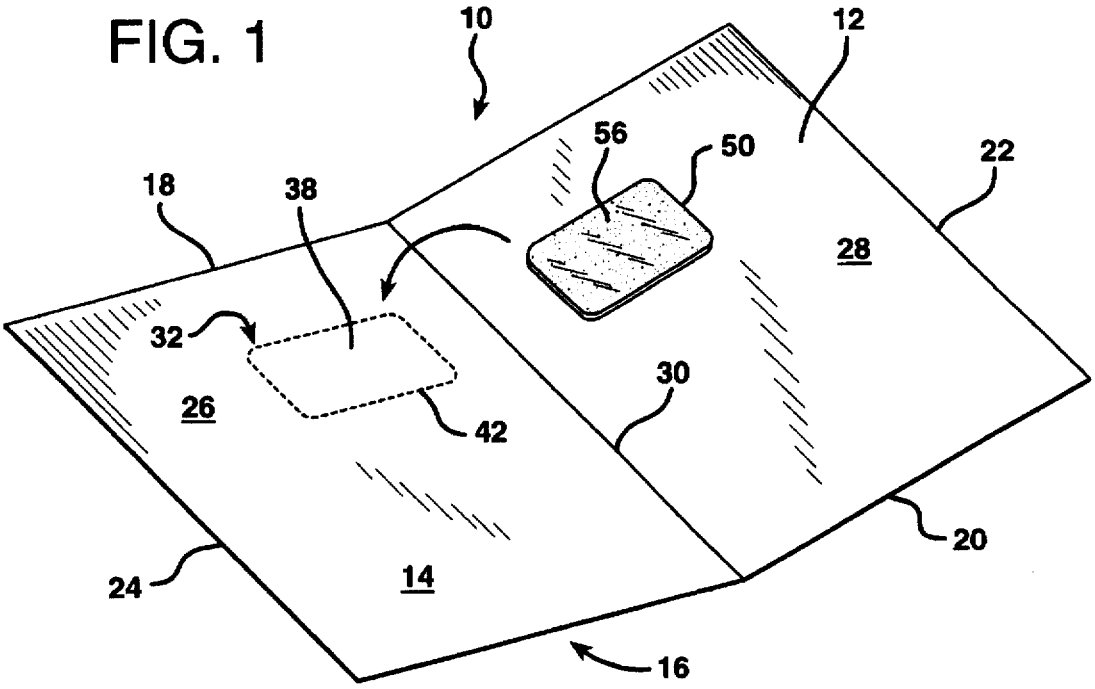
FIG. 1 is a perspective view of the business form or mailer of the present invention including a card as the base ply.
Figure 2:
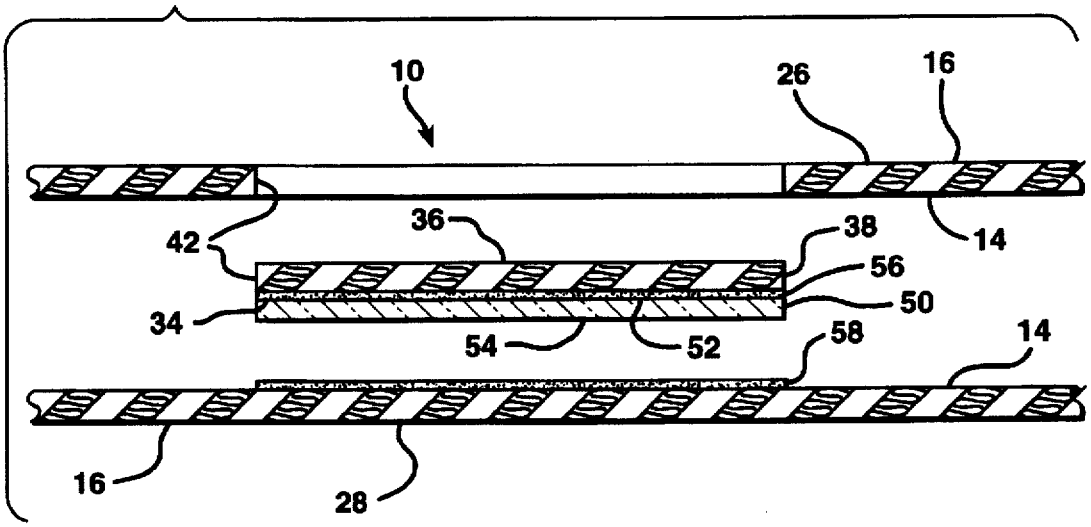
FIG. 2 is an exploded cross-sectional view of the form or mailer of FIG. 1 after lamination of the film ply to the base ply.

Referring now to FIGS. 1 and 2, there is seen the mailer or form 10 of the present invention. Form 10 includes a substrate sheet 12. Substrate sheet 12 may be of any known material common in the art for substrate purposes such as paper of various weights, plastic or composite. Substrate sheet 12 includes first surface 14 and second surface 16, first longitudinal edge 18, second longitudinal edge 20, first end 22 and second end 24. First and second longitudinal edges 18 and 20, respectively, are opposite and parallel each other. First and second end edges 22 and 24, respectively, also are opposite one another.

Substrate 12 may be non-coated or coated on one or both of the first and second surfaces, 14 and 16. Preferably, substrate 12 is a paper coated on first surface 14 with a coating that enhances the bonding of toner images from various printers. These coatings make the image more durable. Toner adhesion enhancing coatings are known in the prior art and include those described in U.S. Pat. No. 5,045,426, the disclosure of which is hereby incorporated by reference.

Substrate 12 is divided into at least a first panel 26 and a second panel 28 by means of at least a first fold line 30. The fold line 30 may be a line of weakness, such as a partial die cut or a line of perforations, to facilitate removal of any of the panels by the user, should that be desired.

Figure 3:
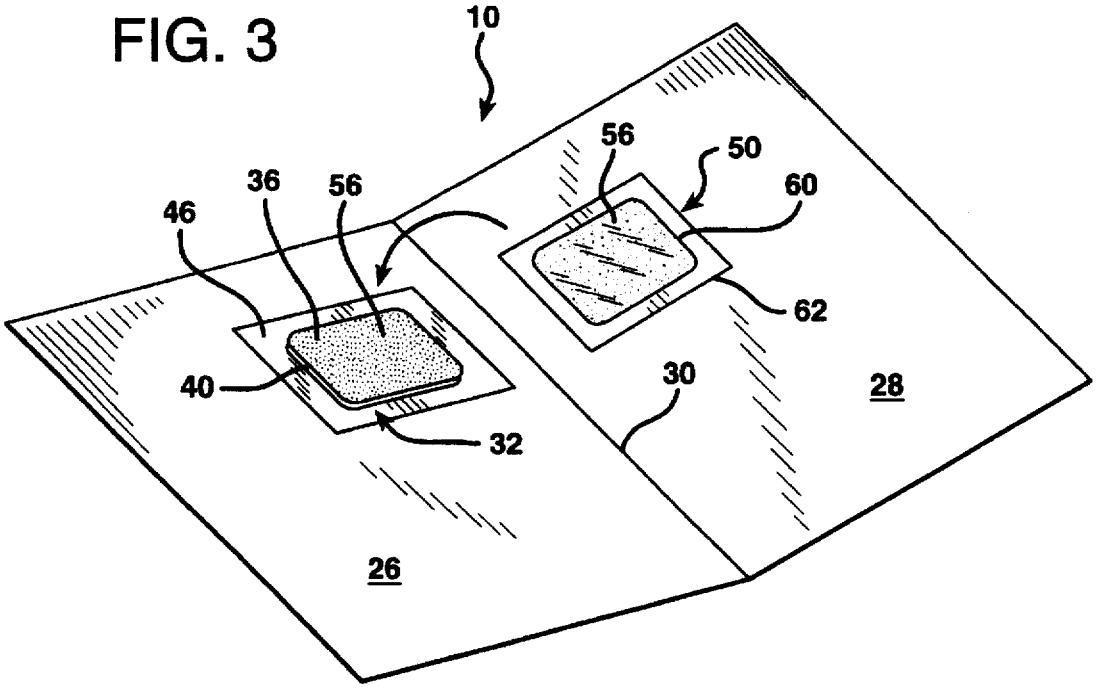
FIG. 3 is a perspective view of the form or mailer of the present invention including a label adhered to the base ply portion of the first panel.

To form the built-in laminated portion of the present invention, a base ply portion 32 is provided on or in the first panel 26. Base ply portion 32 includes an upper surface 34 and a lower surface 36. Base ply portion may be present in multiples on or in the first panel 26. In other words, more than one base ply portion may be provided on or in first panel 26. Base ply portion 32 may be a card 38 formed in substrate 12, a label 40 provided on the first surface 14 of substrate 12 as shown in FIG. 3 or other portion either formed in substrate 12 or formed on first surface of substrate 12. When employing card 38, lines of weakness 42 may be provided in substrate 12 to define card 38.

First and second surfaces 14 and 16 of substrate 12 and upper surface 34 of base ply portion 32 may be printed with variable or nonvariable information. By variable information, it is meant information which varies from form to form such as address or identification number information. By nonvariable information, it is meant information that remains the same from form to form, such as return address information or identification of the issuing body or company. Surfaces 14, 16 and 34 may be printed by means of printing systems such as laser, ink jet, thermal transfer, impact or various other printing systems. Form 10 may be provided in single sheet or continuous web formats. Furthermore, form 10 may be either simplex or duplex printed.

Figure 4:
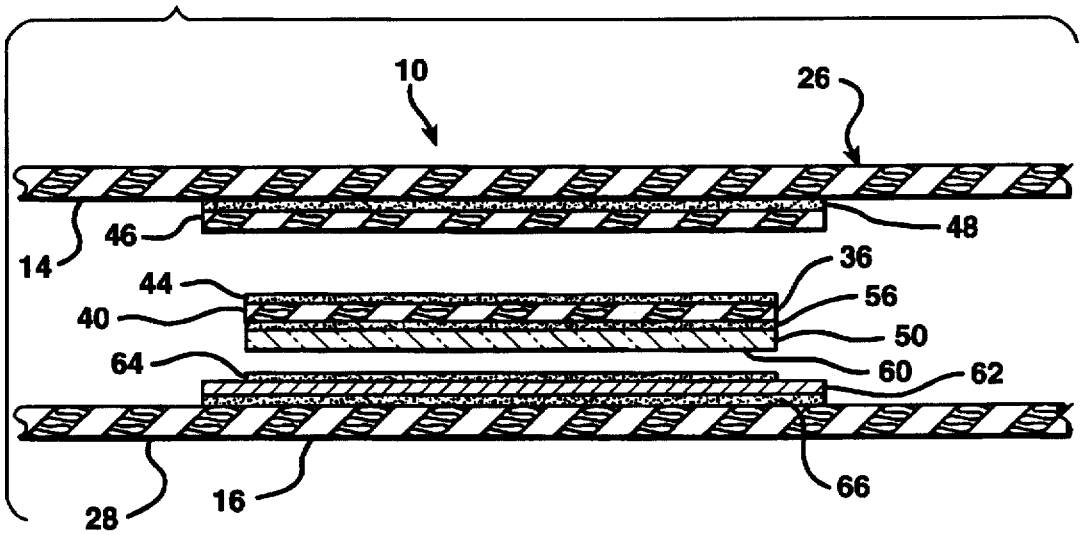
FIG. 4 is an exploded cross-sectional view of the form or mailer of FIG. 3 after lamination of the film ply to the base ply portion of the first panel.

Turning to FIGS. 3 and 4, there is seen a label 40 as base ply portion 32 in first panel 26. Label 40 is provided with a label adhesive 44 on its lower surface 36. Label adhesive 44 is preferably a pressure sensitive adhesive. Label adhesive 44 may be releasably adhered to release liner 46, which is, in turn, adhered by an adhesive material 48 to upper surface 34 of base ply portion 32.

Returning to FIGS. 1 and 2, to provide the laminated covering of the present invention on base ply portion 32, a film ply 50 is provided on the first surface 14 of second panel 28. Film ply portion also includes an upper surface 52 and a lower surface 54. If multiple base ply portions 32 are provided on or in first panel 26, multiple and corresponding number of film ply portions 50 are also employed. Film ply portion 50 is disposed in second panel 28 in such a manner that when form 10 is folded about first fold line 30, the upper surface 52 of the film ply portion 50 is in contact with the upper surface 34 of base ply portion 32. Both film ply portion 50 and base ply portion 32 may be provided in almost any shape and location on substrate 12, with the constraint that, when the form 10 is folded, they are in contact with each other and film ply portion 50 covers the entire surface of base ply portion 32.

A latent, laminating adhesive 56 is then provided on the upper surface 52 of film ply portion 50, on the upper surface 34 of base ply portion 32, or on both surfaces. Laminating adhesive 56 may be any adhesive known in the art suitable for the purpose of laminating a thin film to another surface. A latent adhesive is one which is not tacky and will not adhere to another surface until activated. Such adhesives are well known in the art and include those activated by moisture, heat, pressure, or a combination of heat and pressure. Preferably, the laminating adhesive 56 is a heat and/or pressure activatable adhesive. Thus, when form 10 is folded about the first fold line 30, base ply portion 32 and film ply portion 50 contact each other, i.e., the base ply portion 32 and the film ply portion 50 are positioned opposite each other respect to the first fold line 30.

Laminating adhesive 56 allows film ply 50 to adhere to the upper surface 34 of base ply 32 after application of heat and/or pressure depending upon the chosen adhesive, thereby forming the laminated card or label of the present invention. Of course, one of ordinary skill in the art will recognize that if a heat activatable adhesive is employed as the laminating adhesive 56, then the application of heat will be required, while if a pressure activatable adhesive is employed as laminating adhesive 56 then application of pressure will be required, as well as adhesive on both the upper surface 34 of base ply 32 and the upper surface 52 of film ply 50.

To secure film ply portion 50 in second panel 28, yet allow the film ply 50 to release from the first surface 14 of substrate 12 when the form is unfolded after lamination to remove the base ply portion, a film adhesive 58 may be provided on the lower surface 54 of film ply portion 50. Film adhesive 58 releasably adheres film ply 50 to substrate 12 and is characterizd by a releasable bonding strength. Film adhesive 58 is preferably a dry-residue fugitive adhesive. Dry-residue fugitive adhesives are known in the art and most any would be suitable in this application.

Turning to FIGS. 3 and 4, there is seen an alternative means for releasably securing film ply 50 to substrate 12. Film ply 50 comprises a two-ply film having a first film 60 and a second film 62. First film 60 and second film 62 are releasably adhered to each other by means of a releasable bond 64, such as a peelable, fugitive bond. Such peelable fugitive bonds are known and common in the art, such as for instance MPI-90 from Miller Products, Inc. of New Philadelphia, Ohio. The second film 62 is secured to the substrate 12 by way of a mounting adhesive 66. Mounting adhesive 66 may be any adhesive suitable for securing the second film 62 to the substrate 12 but is preferably a permanent adhesive. In this feature, when the form or mailer is unfolded to remove the card or label, first film 60 remains adhered to base ply portion 32 by way of laminating adhesive 56 while second film 62 remains secured to substrate 12 by way of mounting adhesive 66.

Figure 5:
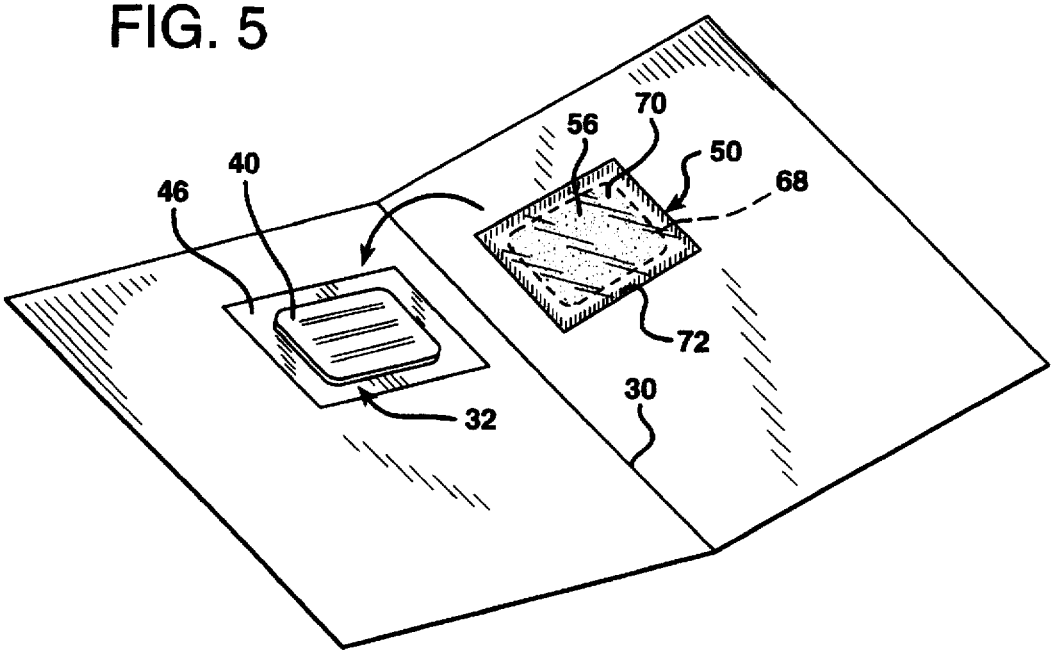
FIG. 5 is a perspective view of the form or mailer of the present invention including a label adhered to the base ply portion of the first panel and with a die-cut hole in the second panel under the film ply.
Figure 6:
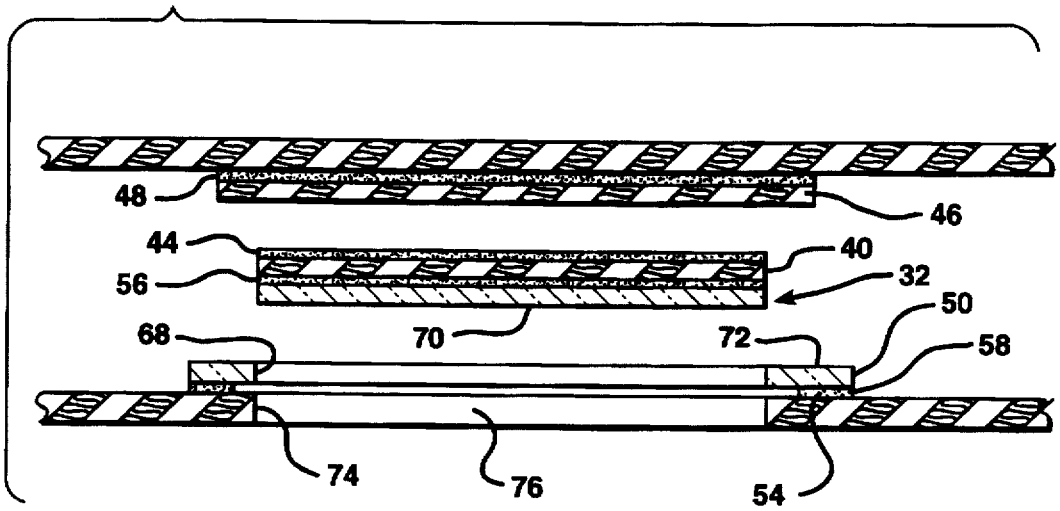
FIG. 6 is an exploded cross-sectional view of the form or mailer of FIG. 5 after lamination of the base ply to the film ply.

Turning now to FIGS. 5 and 6, there is seen yet another alternative for releasably securing film ply portion 50 to substrate 12. Film ply 50 may be provided with lines of weakness 68, such as a die-cut or line of perforation. Lines of weakness 68 define a center or central portion 70 and an edge portion 72 in film ply 50. The lower surface 54 of edge portion 72 is then provided with film adhesive 58. In this instance, film adhesive 58 is preferably a permanent adhesive. Thus, when form 10 is folded, the center portion 70 of film ply 50 is adhered to base ply 32 by way of laminating adhesive 56. The edge portion 72 of film ply 50 remains secured to substrate 12 by way of film adhesive 58. Additionally, if so desired, that portion of substrate 12 in second panel 28 lying in register with center portion 70 may be removed by way of a die-cut 74 to form hole 76. Hole 76 will allow the information printed on the upper surface of base ply 32 to be viewed when the form 10 has been folded.

Figure 7:
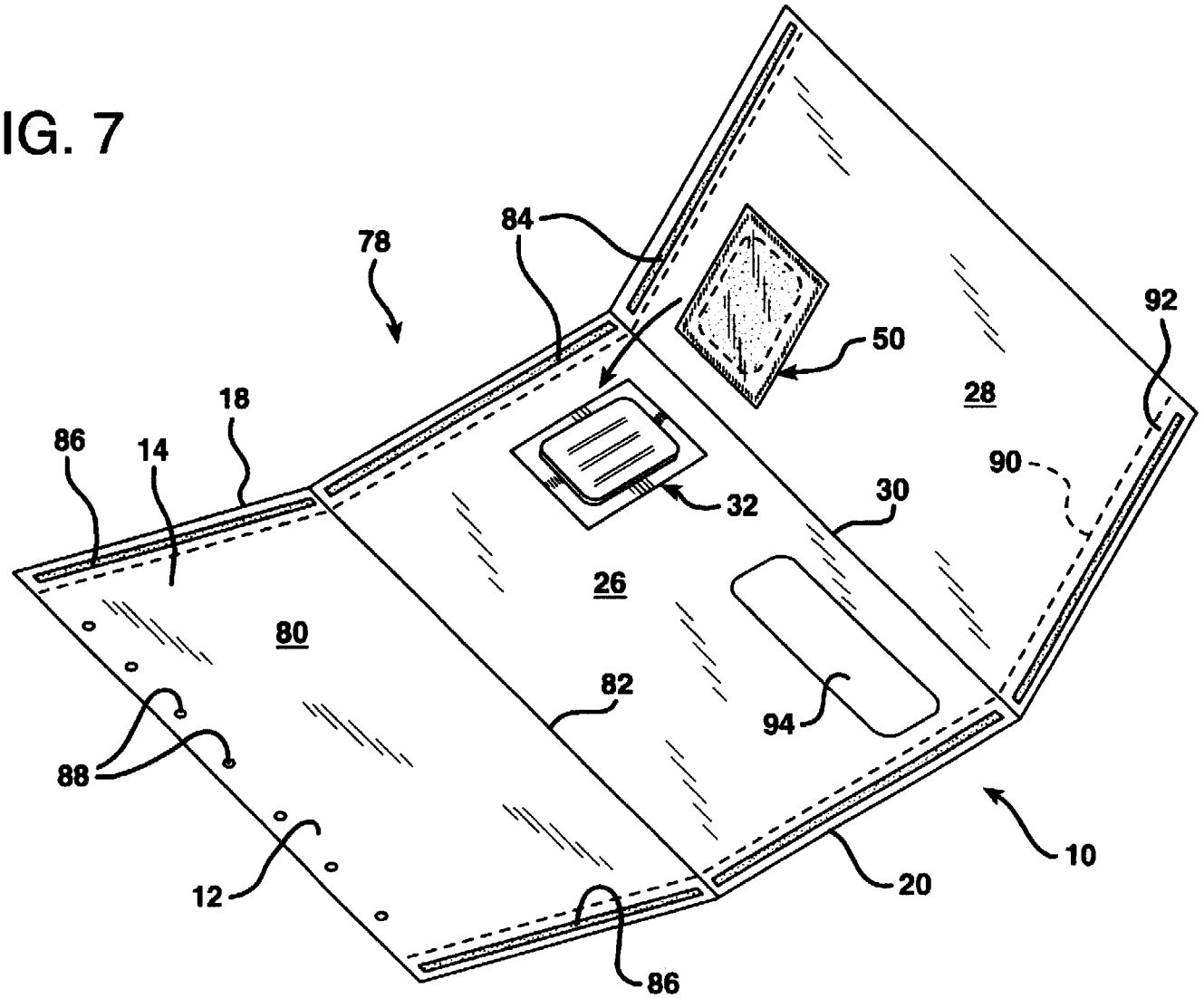
FIG. 7 is a perspective view of the form or mailer of the present invention including three panels formed in the substrate.

Turning now to FIG. 7, there is seen an additional embodiment of the present invention wherein a mailer 78 is provided. Mailer 78 is formed by the addition of a third panel 80 to form 10 and includes all previously described aspects of form 10. Third panel 80 is created by providing a second transverse fold line 82 in substrate 12 perpendicular to the first and second longitudinal edges, 18 and 20. Third panel 80 may be adjacent either the first panel 26 or the second panel 28.

To help seal or secure the mailer 78, a number of adhesive patterns may be provided on mailer 78. To help secure first panel 26 to second panel 28, an edge adhesive 84 may be provided on the first surface 14 of either or both of the first and second panels, 26 and 28. Thus, when mailer 78 is folded about first fold line 30, edge adhesive 84 secures the first panel 26 to second panel 28. Edge adhesive 84 is preferably provided adjacent the first and second longitudinal edges, 18 and 20. Edge Adhesive 84 may be a hot-melt, remoist or pressure activatable adhesive, all of which are well known in the art.

To help secure the third panel 80 of mailer 78, a sealing adhesive 86 is provided on the mailer 78. Sealing adhesive may be provided in one of two patterns depending upon the direction third panel 80 is folded about second fold line 82. Mailer 78 may be folded in a C-fold arrangement. In a C-fold, first surface 14 of the first and second panels 26 and 28 are folded so as to be in contact. Next, third panel 80 is folded so that first surface 14 of third panel 80 is in contact with the second surface of second panel 28. Alternatively, mailer 78 may be folded in a Z-fold arrangement. In a Z-fold, the first and second panels 26 and 28 are folded as in the C-fold. The difference being that the third panel 80 is folded so that the second surface 16 of third panel 80 is in contact with the second surface 16 of the first panel 26.

When employing a C-fold for mailer 78, sealing adhesive 86 is disposed on at least one of the first surface 14 of third panel 80 and the second surface 16 of the second panel 28. When folding mailer 78 in a Z-fold arrangement, sealing adhesive 86 is disposed on at least one of the second surface 16 of the third panel 80 and the second surface 16 of the first panel 26. Sealing adhesive 86 is preferably provided adjacent the first and second longitudinal edges 18 and 20. Sealing adhesive 86 may be a hot-melt, remoist or pressure activatable adhesive, all of which are well known in the art.

To secure the first and second opposite end edges, 22 and 24, an end adhesive 88 may be provided adjacent either the first or second ends 22 and 24. End adhesive 88 may also be a remoist, hot-melt or pressure activatable adhesive. Of course, one of ordinary skill in the art will recognize that if pressure activatable adhesives are employed in the present invention, adhesive will be disposed in corresponding patterns on both surfaces in contact with each other while if a remoist or hot-melt is applied, adhesive need be applied to only one of the surfaces in contact with each other.

In an additional feature, longitudinal lines of weakness 90 may be provided adjacent the first and second longitudinal edges 22 and 24. Lines of weakness 90 run through the entire length of substrate 12. Lines of weakness 90 define a marginal strip portion 92 between the lines of weakness 90 and the longitudinal edges, 22 and 24. To provide for easy opening of the mailer upon arrival at it's destination, edge adhesive 84 and sealing adhesive 86 are preferably disposed on marginal strips 92. In this manner, marginal strips 92 may be removed by the recipient by tearing along the lines of weakness 90. Removing marginal strips 92 removes the adhesive securing mailer 78 thereby allowing easy access to the inside of the mailer 78.

An address window 94 may also be provided in the mailer 78. Address window 94 may be disposed in any of the first panel 26, the second panel 28 or the third panel 80. Address window 94 may simply be a cut-out opening in substrate 12 thereby allowing the outgoing address to be viewed. Alternatively, address window 94 may be covered by any number of translucent or clear films well known in the art which will allow the outgoing address to be viewed while protecting the substrate 12 beneath the plastic film.

Of course, one of ordinary skill in the art will recognize that the mailer according to the present invention may easily be produced by adding the edge adhesive 84 to the form 10. In the same manner, mailer 78 may be easily converted to form 10, by eliminating the various adhesive patterns. The business form 10 may then be added to an envelope or package for mailing. However, if so desired, the various adhesive patterns may be included while still forming a business form 10 to be included in an envelope or package.

Having described the invention in detail and by reference to the preferred embodiment thereof, it will be apparent that modifications and variations are possible without departing from the scope of the invention which is defined in the appended claims.

What is claimed is:

1. A business form or mailer intermediate comprising:

a substrate sheet having first and second surfaces, first and second parallel longitudinal edges and first and second opposite ends;

at least a first transverse fold line formed in said substrate perpendicular to said parallel longitudinal edges, said at least first fold line dividing said substrate into at least first and second panels;

at least one base ply portion having an upper and a lower surface, said base ply portion being detachably secured to said first panel of said substrate;

at least one protective laminate portion positioned opposite and in substantial alignnment with said base ply portion with respect to said first transverse fold line, said protective laminate portion having an upper surface and a lower surface, said protective laminate portion being secured to said first surface in said second panel via a releasable bond characterized by a releasable adhesive bonding strength; and a laminating adhesive provided on one or both of said upper surface of said base ply and said upper surface of said protective laminate wherein said laminating adhesive is characterized by a laminating adhesive bonding strength and wherein said laminating adhesive bonding strength exceeds said releasable adhesive bonding strength.

2. The business form or mailer intermediate as claimed in claim 1 wherein said base ply portion is a card formed in said substrate in said first panel.

3. The business form or mailer intermediate as claimed in claim 1 wherein said base ply portion is a label formed on said first surface in said first panel of said substrate.

4. The business form or mailer intermediate as claimed in claim 1 wherein multiple base ply portions are provided in said first panel and multiple protective laminate portions are provided on said second panel.

5. The business form or mailer intermediate as claimed in claim 3 further including a label adhesive disposed on said lower surface of said label.

6. The business form or mailer intermediate as claimed in claim 5 further including a liner ply disposed on said first surface of said substrate sheet, said label being releasably adhered to said liner ply by means of said label adhesive.

7. The business form or mailer intermediate as claimed claim 1 wherein said laminating adhesive is a hot-melt or pressure activatable adhesive.

8. The business form or mailer intermediate as claimed in claim 5 wherein said label adhesive is a pressure activatable adhesive.

9. The business form or mailer intermediate as claimed in claim 1 wherein said protective laminate portion further includes a film adhesive disposed on said lower surface of said protective laminate portion.

10. The business form or mailer intermediate as claimed in claim 9 wherein said film adhesive is a dry-residue fugitive adhesive.

11. The business form or mailer intermediate as claimed in claim 1 wherein said protective laminate portion includes lines of weakness thereby defining a center portion and an edge portion.

12. The business form or mailer intermediate as claimed in claim 11 wherein said lower surface of said edge portion on said protective laminate portion is provided with said film adhesive.

13. The business form or mailer intermediate as claimed in claim 12 wherein said film adhesive is a permanent adhesive.

14. The business form or mailer intermediate as claimed in claim 11 wherein a portion of said substrate lying in register with said center portion in said protective laminate portion includes a die-cut hole.

15. The business form or mailer intermediate as claimed in claim 1 wherein said protective laminate portion comprises a two-ply film having a first film and a second film releasably adhered to each other.

16. The business form or mailer intermediate as claimed in claim 15 wherein said second film is adhered to said substrate with a mounting adhesive.

17. The business form or mailer intermediate as claimed in claim 16 wherein said mounting adhesive is a permanent adhesive.

18. The business form or mailer intermediate as claimed in claim 1 further including a second transverse fold line formed in said substrate perpendicular to said parallel longitudinal edges thereby defining a third panel adjacent said first or second panels.

19. The business form or mailer intermediate as claimed in claim 18 further including lines of weakness adjacent said first and second parallel longitudinal edges defining marginal strips between said lines of weakness and said first and second parallel longitudinal edges.

20. The business form or mailer intermediate as claimed in claim 19 further including an edge adhesive disposed on said first surface on said marginal strips in at least one of said first and second panels.

21. The business form or mailer intermediate as claimed in claim 20 further including an address window disposed in one of said first, second, or third panels.

22. The business form or mailer intermediate as claimed in claim 19 further including a sealing adhesive disposed on said marginal strips on either said second surface of said second panel and said first surface of said third panel or second surface of said first panel and said second surface of said third panel.

23. The business form or mailer intermediate as claimed in claim 20 further including an end adhesive disposed adjacent said first or second opposite ends.

24. A mailer intermediate comprising:

a substrate sheet having first and second surfaces, first and second parallel longitudinal edges and first and second opposite ends;

first and second transverse fold lines formed in said substrate perpendicular to said parallel longitudinal edges, said first and second fold lines dividing said substrate into first, second and third panels, said first fold line separating said first and second panels;

a base ply portion having an upper and a lower surface, said base ply portion being detachably secured to one of said first or second panels of said substrate;

a protective laminate portion positioned opposite and in substantial alignment with said base ply portion with respect to said first transverse fold line, said protective laminate portion having an upper surface and a lower surface, said protective laminate portion being secured to said first surface in another of said first or second panels via a releasable bond characterized by a releasable adhesive bonding strength; and a laminating adhesive provided on one or both of said upper surface of said base ply and said upper surface of said protective laminate wherein said laminating adhesive is characterized by a laminating adhesive bonding strength and wherein said laminating adhesive bonding strength exceeds said releasable adhesive bonding strength.

25. The mailer intermediate as claimed in claim 24 wherein said base ply portion is a card formed in said substrate.

26. The mailer intermediate as claimed in claim 24 said base ply portion is a label formed on said first surface of said substrate.

27. The mailer intermediate as claimed in claim 24 wherein multiple base ply portions are provided in said first panel and multiple protective laminate portions are provided on said second panel.

28. The mailer intermediate as claimed in claim 24 further including lines of weakness adjacent said first and second parallel longitudinal edges defining marginal strips between said lines of weakness and said first and second parallel longitudinal edges.

29. The mailer intermediate as claimed in claim 28 further including an edge adhesive pattern disposed on said first surface of said marginal strips in at least one of said first and second panels.

30. The mailer intermediate as claimed in claim 29 further including a sealing adhesive disposed on said marginal strips on either said second surface of said second panel and said first surface of said third panel or said second surface of said first panel and said second surface of said third panel.

31. The mailer intermediate as claimed in claim 24 further including an address window disposed in one of said first and second panels.

32. The mailer intermediate as claimed in claim 24 further including an end adhesive disposed adjacent said first or second opposite ends.

33. The business form or mailer intermediate as claimed in claim 1 wherein said base ply portion is a tag formed in said substrate or on said first surface of said substrate.

34. The business form or mailer intermediate as claimed in claim 1 wherein lines of weakness are provided in said substrate to define said base ply portion.

35. A business form or mailer intermediate comprising:

a substrate sheet having first and second surfaces, first and second parallel longitudinal edges and first and second opposite ends;

at least a first transverse fold line formed in said substrate perpendicular to said parallel longitudinal edges, said at least first fold line dividing said substrate into at least first and second panels;

at least one label having an upper and a lower surface, said label being formed on said first surface in said first panel of said substrate;

at least one protective laminate portion having an upper surface and a lower surface, said protective laminate portion being provided on said first surface in said second panel, said protective laminate portion being positioned opposite to and in substantial alignment with said label with respect to said first transverse fold line;

a label adhesive disposed on a lower surface of said label;

a liner ply disposed on said first surface of said substrate sheet, said label being releasably adhered to said liner ply by means of said label adhesive; and a laminating adhesive provided on one or both of said upper surface of said label and said upper surface of said protective laminate wherein when said substrate is folded about said at least first fold line said protective laminate portion adheres to said label.

36. A business form or mailer intermediate comprising:

a substrate sheet having first and second surfaces, first and second parallel longitudinal edges and first and second opposite ends;

at least a first transverse fold line formed in said substrate perpendicular to said parallel longitudinal edges, said at least first fold line dividing said substrate into at least first and second panels;

at least one base ply portion having an upper and a lower surface, said base ply portion being provided in said substrate in said first panel or on said first surface in said first panel;

at least one protective laminate portion having an upper surface and a lower surface, said protective laminate portion being provided on said first surface in said second panel, opposite to and in substantial alignment with said base ply portion with respect to said first transverse fold line, wherein said protective laminate portion further includes a film adhesive disposed on said lower surface; and a laminating adhesive provided on one or both of said upper surface of said base ply and said upper surface of said protective laminate wherein when said substrate is folded about said at least first fold line said protective laminate portion adheres to said base ply portion.

* * * * *